United States Patent [19]

Masterton et al.

[11] 4,155,706

[45] May 22, 1979

[54] BATCH ANNEALING FURNACES

[75] Inventors: Donald J. Masterton, Caerleon; Donald R. Rees, Cwmbran, both of Wales

[73] Assignee: British Steel Corporation, London, United Kingdom

[21] Appl. No.: 796,732

[22] Filed: May 13, 1977

[30] Foreign Application Priority Data

May 20, 1976 [GB] United Kingdom ..... 20896/76

[51] Int. Cl.[2] ..... F27B 9/28

[52] U.S. Cl. ..... 432/260; 266/274

[58] Field of Search ..... 432/253, 258, 259, 260, 432/254.1, 254.2; 266/274; 248/19, 346, 346.1

[56] References Cited

U.S. PATENT DOCUMENTS

| | | | |
|---|---|---|---|
| 2,043,456 | 6/1936 | Watrous, Jr. | 432/260 |
| 2,479,102 | 8/1949 | Dailey, Jr. | 432/260 |
| 2,485,453 | 10/1949 | Munford | 432/254.2 |
| 3,294,598 | 12/1966 | Norris | 266/274 |
| 3,670,877 | 6/1972 | Reed | 206/413 |

*Primary Examiner*—John J. Camby

*Attorney, Agent, or Firm*—Bacon & Thomas

[57] ABSTRACT

A support for a workpiece to be heated, the support comprising a laminate of metal strip arranged in face-to-face relation with the adjacent normally upper strip edges forming a support surface.

1 Claim, 1 Drawing Figure

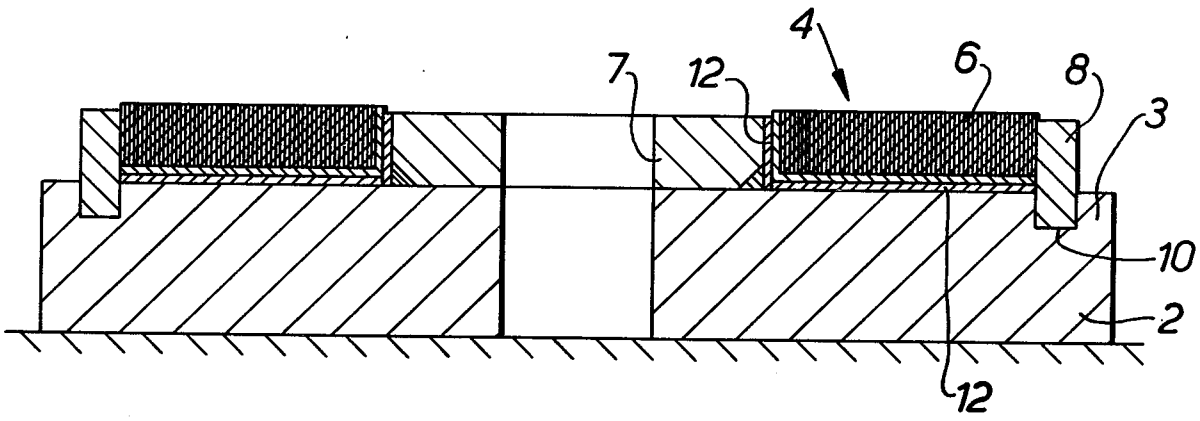
4
6
8
3
12
7
12
10
2

BATCH ANNEALING FURNACES

This invention relates to heat treatment and is particularly, but not exclusively, concerned with the batch annealing of metal such as steel strip.

The production of steel strip generally involves at least one annealing operation effective to relieve the effects of work hardening produced by a cold reducing operation. The present invention is concerned with batch annealing in which a coil of the strip is supported within a suitable heating furnace providing the appropriate temperature-time cycle for the strip in the coil.

Conventional practice is for the coil to be supported within the furnace upon a substantially circular metal plate which may be flat or tapered and, if required, for one or more further coils to be supported above the base coil by way of a similar plate supported by a stalk passing through the centre of the lower coil. The support plates are normally of alloy steel, but mild steel plates may be used with a corresponding increase in thickness to compensate for the relatively lower strength of mild steel.

In the case of relatively high temperature annealing for example at a temperature within the range 1000° C. to 1250° C. used during annealing silicon steel strip for electromagnetic applications, the use of conventional steel plates for coil support in a batch annealing furnace presents a number of difficulties. These include sagging and distortion of the support plates which give rise to local areas of high loading. Such uneven loading places excessive strain on the corresponding regions of coil supported on a plate and may damage the strip at these regions to an extent which requires the damaged regions to be subsequently discarded.

In addition the life of the support plates is reduced to a limited number of thermal cycles as a result of cracking, and it is one object of the present invention to reduce the disadvantages arising from such conventional supports.

According to its broadest aspect the present invention provides, in or for a heating furnace, a support member for a workpiece to be heated, the member comprising a laminate of metal strip arranged in face-to-face relation so that the array of adjacent upper edges provides the support surface.

In a preferred embodiment of the invention the laminate comprises one or more lengths of continuous metal strip which is wound onto a former to produce a shallow coil whose upper end face provides the support surface.

The metal strip selected for use in the support member will however be dependent upon the nature of the workpiece to be heated and upon the temperature of the heating furnace. Clearly the metal strip will be selected to have a melting point below the temperature reached by the furnace and to produce the minimum contamination of the workpiece. Thus where the workpiece is a steel coil to be heat treated in a batch annealing furnace, the support itself is suitably of steel strip. In this case the steel of the support is of low carbon content, preferably below 0.06 percent, in order to minimise contamination by carbon-bearing gases. However, any steel, for example high alloy steels, stainless steels, or silicon steels may be used.

Adjacent faces of strip in the laminate may be contiguous; they may however be suitably spaced or may be separated by a non-metallic material such as a refractory.

An embodiment of the invention will now be particularly described by way of example with reference to the accompanying drawing which is a sectional side view of the base of a furnace for the batch annealing of steel coils.

Referring to the drawing, the base of the annealing furnace includes an annular steel disc 2 which is permanently disposed upon a brickwork support (not shown).

Disposed above the disc 3 is the actual support for the steel coils which will be contained within the furnace and will be subjected to the appropriate heating cycle after the furnace inner cover has been placed in position upon the seating provided by the outer groove 3 of the disc, or upon or within an annular seating on or in the brickwork support.

As shown, the coil support indicated generally at 4, comprises a shallow coil itself of steel strip 6 which is tightly wound upon an annular former 7, typically made by welding a mild steel ring onto a mild steel disc.

The spirally-wound support laminate is placed upon the base 2 and is retained in position by an outer retaining ring 8. This comprises two lengths of shaped mild steel bar which are welded into a groove 10 inboard of the seating 3 for the furnace inner cover and which may be inclined towards the centre of the spiral. The diameter of the central aperture on the base 2 and in the former 7 is sufficient to accommodate a support for a stalk effective to carry a similar support above a steel coil placed upon the support 4.

In order to reduce heat loss the wound steel strip 6 is spaced from the base 2 and from the former 7 by way of an asbestos layer 12.

The steel of the base 2 and the strip 6 preferably has a carbon content of less than 0.06 percent in order to reduce the risk of contamination within the annealing furnace by carbon-bearing gases.

It has been found that the use of a laminated support provides an improved life before distortion reaches an unacceptable level. In general, the life of the support is limited by the distortion of the retaining ring 8, and in this case the support can be renovated by removing the ring 8 and damaged turns of the spiral 6 and fitting a new and undistorted retaining ring.

It will be appreciated that while the invention has been described with reference to the support of steel coils within a batch annealing furnace, it can mutatis mutandis be applied to the support of a workpiece in any heating furnace in which the temperature-time conditions are such as to reduce the life of a solid workpiece support.

We claim:

1. A support for a workpiece to be heated, the support comprising a tightly wound substantially continuous length of metal strip in the form of a shallow, spiral flat coil, said metal strip having an upper edge lying substantially in a single plane to present a planar load bearing support surface, the strip extending vertically from said upper edge; said strip having a bottom edge also lying in substantially a single plane extending parallel to the plane including the top edge; a non-metallic layer between the layers of metal strip; all the metal and non-metal layers being contiguous.

* * * * *